United States Patent [19]

Sando et al.

[11] 4,116,023

[45] Sep. 26, 1978

[54] CONTINUOUS WATER WASHING APPARATUS FOR CLOTH

[75] Inventors: Yoshikazu Sando; Hiroshi Ishidoshiro; Takashi Tsuchihashi; Keiji Saika, all of Wakayama, Japan

[73] Assignee: Sando Iron Works Co., Ltd., Japan

[21] Appl. No.: 798,354

[22] Filed: May 19, 1977

[30] Foreign Application Priority Data

| | | | |
|---|---|---|---|
| May 27, 1976 | [JP] | Japan | 51-61482 |
| May 27, 1976 | [JP] | Japan | 51-61483 |
| May 27, 1976 | [JP] | Japan | 51-61484 |

[51] Int. Cl.[2] ..... D06B 3/12; D06B 23/04

[52] U.S. Cl. ..... 68/13 R; 68/183; 68/207

[58] Field of Search ..... 68/13 R, 22 R, 175, 68/181 R, 183, 207, 212

[56] References Cited

U.S. PATENT DOCUMENTS

| | | | |
|---|---|---|---|
| 1,209,465 | 12/1916 | Matter | 68/22 R X |
| 2,583,267 | 1/1952 | Jones et al. | 68/207 X |
| 3,064,458 | 11/1962 | Grimes | 68/22 R |
| 3,199,317 | 8/1965 | Walsh | 68/207 X |
| 3,655,328 | 4/1972 | Sando et al. | 68/183 X |
| 3,950,802 | 4/1976 | Schiffer et al. | 68/181 R X |

*Primary Examiner*—Philip R. Coe

*Attorney, Agent, or Firm*—Toren, McGeady and Stanger

[57] ABSTRACT

A continuous water washing apparatus for cloth, includes first multi-layer guide rolls which pull up the cloth being processed and shift it in the horizontal direction, over the guide rolls which are provided in a staggered and opposing manner above a pre-washing tank containing a set of second multi-layer guide rolls and pressurized air blow out pipes. A water receptacle is provided for each of the first guide rolls arranged in a pair of spaced vertical columns, and a cleaning water supply mechanism is connected to the uppermost water receptacle. A sag prevention mechanism holds the cloth in a horizontally shifting manner and includes a tension detection mechanism. Further, a shifting speed detection mechanism is provided for the cloth, and includes a cloth width detection mechanism and a water filling up volume adjusting mechanism for the water receptacles operated by the cloth width detection mechanism.

4 Claims, 7 Drawing Figures

CONTINUOUS WATER WASHING APPARATUS FOR CLOTH

BACKGROUND OF THE INVENTION

The present invention relates to a water washing apparatus which can save on water consumption and can continuously conduct effective water washing of the cloth.

Heretofore various kinds of continuous water washing apparatus for cloth have been developed because a cloth which has been dyed, scoured, bleached, and resin processed, etc., needs to be washed in a continuous manner. However, in such water washing apparatus, generally speaking a large volume of water is used, therefore it cannot meet the requirement for conserving water resources now considered to be a worldwide necessity. When it is tried to save on water in a conventional water washing apparatus there is the problem that the processing agent used in a preceding process remains in the cloth after the water washing process leaving mottled spots in the finished product, thus a large amount of cleaning water is used to avoid the problem.

The present inventors have developed a water washing apparatus which meets the requirement for saving water resources and have applied for a patent for such a water saving type of washing apparatus which includes a liquid tank having its upper end open, and multi-layer guide rolls in two opposing columns, in a staggered arrangement are provided above the liquid tank for continuously pulling up the cloth upward in a zigzag manner. Water receptacles are provided below the guide rolls so that a lower plane of each guide roll is dipped in the water. Further, a cleaning water supply tank provides cleaning water to the uppermost water receptacle so that cleaning water is supplied, in turn to each water receptacle, flowing down by gravity.

However, in the water washing apparatus of the previous patent application, cleaning water stagnates on the cloth being processed as it is shifted upwardly from the liquid tank and is placed around the oppositely disposed guide rolls in a staggered manner for horizontal shifting. A sag is generated on a horizontally shifting portion of the cloth due to the weight of the stagnating water, and the sag causes creases in the cloth as it is shifted around the guide rolls, forming obstacles for uniform water washing and causing an unsightly finished product.

Further, the present inventors have observed such insufficiency or shortcoming in the above mentioned water washing apparatus in the previous patent application for avoiding the waste of water, since each water receptacle is completely filled with water, when the width of the cloth being processed is considerably narrower than the total width of the water receptacle, the cleaning water in the side portions of the water receptacle not occupied by the cloth does not serve for cleaning process and flows out to the next lower water receptacle uselessly. Accordingly the inventors have felt a need for further improvement to ensure the water preservation.

Moreover, in the water washing apparatus of the previous patent application, since cleaning water is supplied without any relationship to the shifting speed of the cloth being processed, for example when the amount of cleaning water flows out is not in balance with the shifting speed of the cloth, cleaning water will be wasted or the cleaning process will be incomplete, thus an effective cleaning may not be done. That is, the amount of water flowing out needs to be adjusted so that it is not in excess nor in short supply considering the shifting speed of the cloth.

SUMMARY OF THE INVENTION

An object of the present invention is to provide continuous water washing apparatus for a cloth, which eliminates the shortcomings of conventional apparatus and of the above mentioned water saving type of washing apparatus of the previous application by providing an improvement for the apparatus of the previous application and includes a mechanism for removing any sag caused in the cloth by the gravity action of water, a mechanism for automatically adjusting the volume of water to fill a water receptacle so that the width of water in the receptacle is filled according to the width of the cloth being processed, and a mechanism for automatically adjusting the amount of cleaning water flowing out corresponding to the shifting speed of the cloth. The improved apparatus of the present invention can achieve the object of fundamental water saving and can simultaneously conduct an effective water cleaning process.

In the continuous water washing apparatus for cloth according to the present invention, multilayer guide rolls are provided in a staggered and an opposing manner within a pre-washing tank for shifting the cloth being processed in a parallel manner, and air blow out pipes are provided in a horizontal row between paths of the cloth in adjacent parallel columns and at intermediate positions between upper and lower rows of guide rolls. Further other multi-layer guide rolls are vertically arranged in a staggered manner above the pre-washing tank to pull the cloth upwardly and to shift it in a horizontal manner. Water receptacles are provided below the guide rolls in each stage so that the lower plane of each guide roll is dipped into the cleaning water. Moreover a cleaning water supply mechanism, connected to the uppermost water receptacle is provided so that the cleaning water consecutively flows by gravity into the water receptacle at each stage. A mechanism is provided including a shifting speed detection mechanism and a tension detection mechanism for the cloth along with the sag prevention member for a horizontal shifting portion of the cloth. Further, a mechanism with a width detection mechanism for the cloth, adjusts the width of the water in the water receptacles.

When a cloth mixed spinned with 65% of Tetron polyester and 35% cotton was subjected to a cleaning process in the above mentioned water washing apparatus by adjusting the amount of cleaning water flowing according to the shifting speed of cloth, the relationship between the shifting speed of the cloth and the amount of cleaning water supplied is made clear by a graph shown in FIG. 1.

Next, the details of the continuous water washing apparatus for cloth according to the present invention will be explained.

DESCRIPTION OF THE PREFERRED EMBODIMENT

Figure 2:
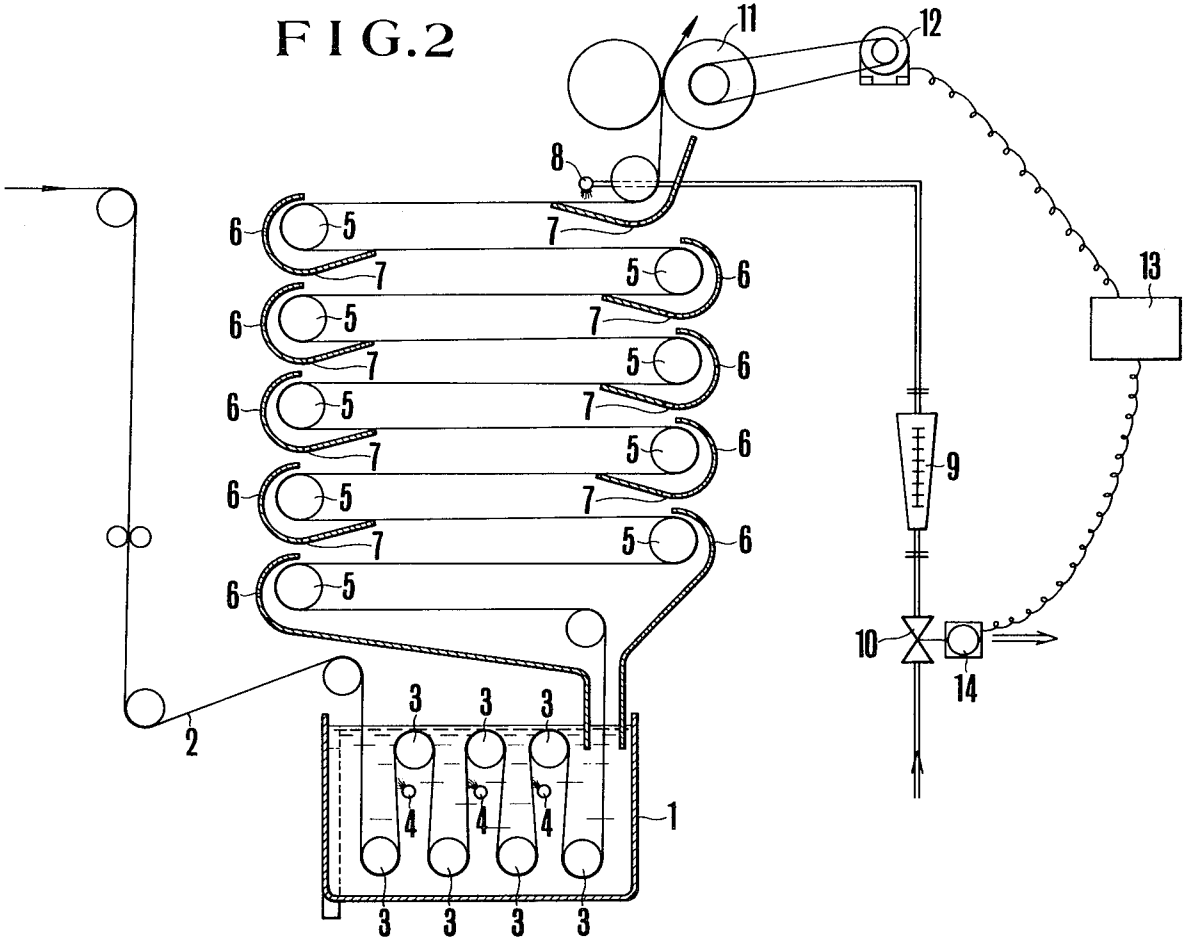
FIG. 2 is a side elevation illustrating only important members in an example of a continuous water washing apparatus according to the present invention.

In an example of a continuously operating water washing apparatus for cloth according to the present invention, FIG. 2 is a side elevation showing only important component members, omitting such component members as a sag prevention mechanism for retaining the cloth during horizontal shifting, a tension detection mechanism and a cloth width detection mechanism, etc., to avoid complication in the drawing.

In FIG. 2 guide rolls (3) are arranged in an oppositely disposed staggered manner within a pre-washing tank (1) positioned at the lower part of the FIGURE so that a cloth (2) to be processed, introduced into the tank from the outside, is shifted in an up and down vertical and zigzag manner. Pressurized air blow out pipes (4) are provided in a horizontal row between adjacent vertically extending portions of the cloth (2) which runs over the guide rolls (3) and the pipes are located at intermediate positions between the guide rolls opposingly provided in upper and lower rows.

Above the pre-washing tank 1 other multi-layer guide rolls (5) are staggered in a pair of laterally spaced vertical columns for guiding the cloth 2 upwardly and horizontally in a zigzag manner. Further, a water receptacle 6, having water flow out holes 7 perforated in its bottom, is positioned below each of the guide rolls. A cleaning water supply mechanism is connected to the uppermost guide roll 5. The cleaning water supply mechanism consists of a water supply pipe 8 having a water supply outlet placed close to the uppermost guide roll stage, a flow meter 9 is connected to a source of water supply (not shown in the drawing) through a valve 10, follower rolls 11 rotate following the shifting of the cloth, a speed detector 12 receives the rotation power of the follower rolls 11, a prescribed output converter 13 converts the output from detector 12, and a motor 14 operates the valve 10 through the converter 13.

In the above mentioned system, first, the shifting speed of a cloth 2 being processed is detected by the follower rolls 11 and the speed detector 12, and the degree of opening of the valve 10 is adjusted by the driving motor 14 corresponding to the output from the detector 12, thus an optimum amount of cleaning water for the automatically adjusted shifting speed of the cloth 2 is supplied from the water supply pipe 8 into the receptacle 6 containing the uppermost roll 5.

Figure 1:
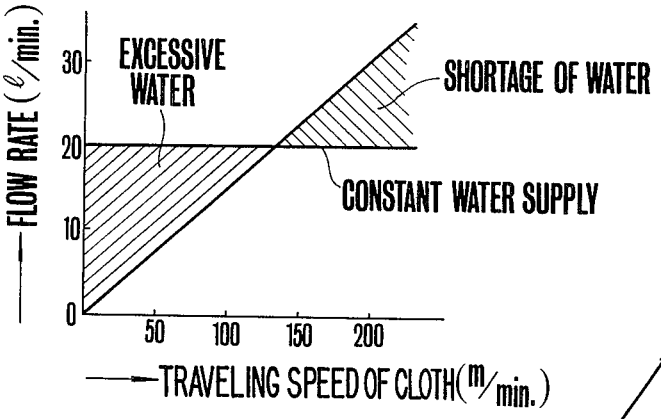
FIG. 1 is a graph showing the relationship between the amount of water supplied and the shifting speed of the cloth.

When the degree of opening of the valve, corresponding to the shifting speed of the cloth, is set beforehand so that the amount of cleaning water supplied from the water supply pipe has a relationship shown by the oblique line *a* in FIG. 1 against the shifting or traveling speed of the cloth, useless outflow of cleaning water can be prevented. Further when feeding of the cloth is stopped, the water supply is automatically stopped reducing the amount of water supplied to zero, thus efficient water washing can be done, and the requirement for conserving water resources can be met, which is an object of the present invention. Further, with converter 13, the adjustment of unit volume of water supplied can be set beforehand, according to the thickness of cloth to be processed.

In addition to the important above described mechanism, another mechanism is provided for preventing any sag in the cloth caused by the weight of cleaning water when the cloth is shifted horizontally.

Figure 3:
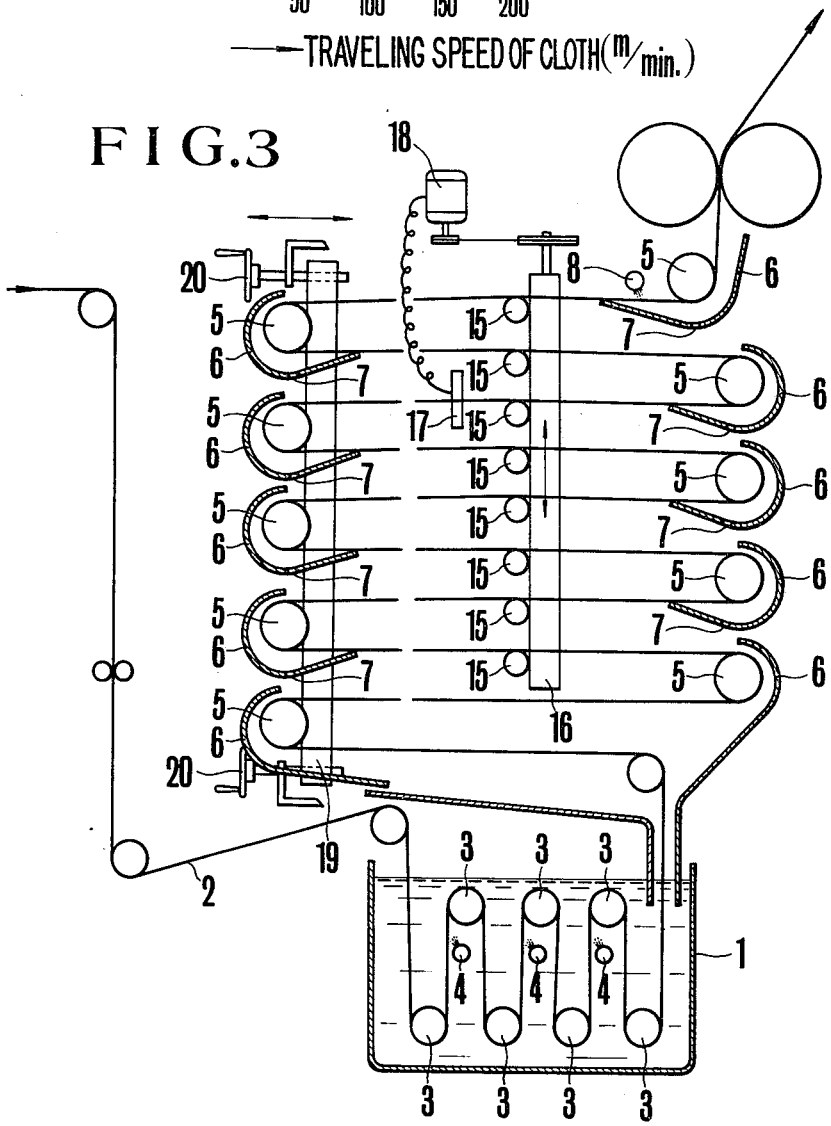
FIG. 3 is a side elevation which particularly shows a sag prevention mechanism for cloth including a tension detection mechanism.

FIG. 3 shows the said sag prevention mechanism, which consists of touch rolls 15 provided at almost centrally between the multi-layer guide rolls 5 oppositely disposed in a staggered manner in two columns, left and right, an attaching frame 16 commonly supports each of the touch rolls 15 in a freely rotatable manner, a tension detector 17 having a pair of a light emitter and a light receiver, contacts with both edges of the shiting cloth, and a motor 18 is driven by the output from detector 17, further, a roll supporting frame 19 axially supporting the multi-layer guide rolls in one row out of the two rows, and is shifted in the lateral direction by a handle 20 to adjust the mutual distance beween the two rows of the guide rolls 5.

By providing a sag prevention mechanism for the cloth, when the cloth is placed around the guide rolls 5 during the washing process and is shifted horizontally, cleaning water having its volume adjusted flows from the water supply pipe 8 and flows against the shifting of the cloth and is stored in the uppermost water receptacle 6, then the stored water further flows downwardly through the water outlet holes 7, and a portion thereof flows consecutively into the lower water receptacles while the other portion thereof is shifted or carried by cloth 2. As a result pressure is applied to the cloth and the guide rolls 5, but the horizontal portions of the cloth positioned between left and right rows of guide rolls 5, 5 have a tendency to sag because of the weight of water therein, and as the sag develops, the tension detector 17 detects the sag in the cloth and the motor 18 is driven by the detection output, shifting the above mentioned attaching frame 16 up and down by the driving power of the motor, and the touch rolls contact the cloth positioned between the left and right rows of guide rolls 5, 5 to control the tension, thus automatically eliminating the sag.

Therefore, with the sag of the cloth, caused by the gravity force of the water acting on the cloth during the washing process, automatically eliminated, such as creases in the cloth which are apt to take place during the process and washing spots caused by the generation of creases, etc., are eliminated. Thus uniform and effective continuous water washing can be achieved which is particularly advantageous for water washing of a woven fabric which is easily expandable such as a knitted material.

Furthermore, the above mentioned example has a mechanism for automatically adjusting the volume of water within the water receptacle as it is filled so that the width of water within the receptacle corresponds to the width of the cloth being processed.

Figure 4:
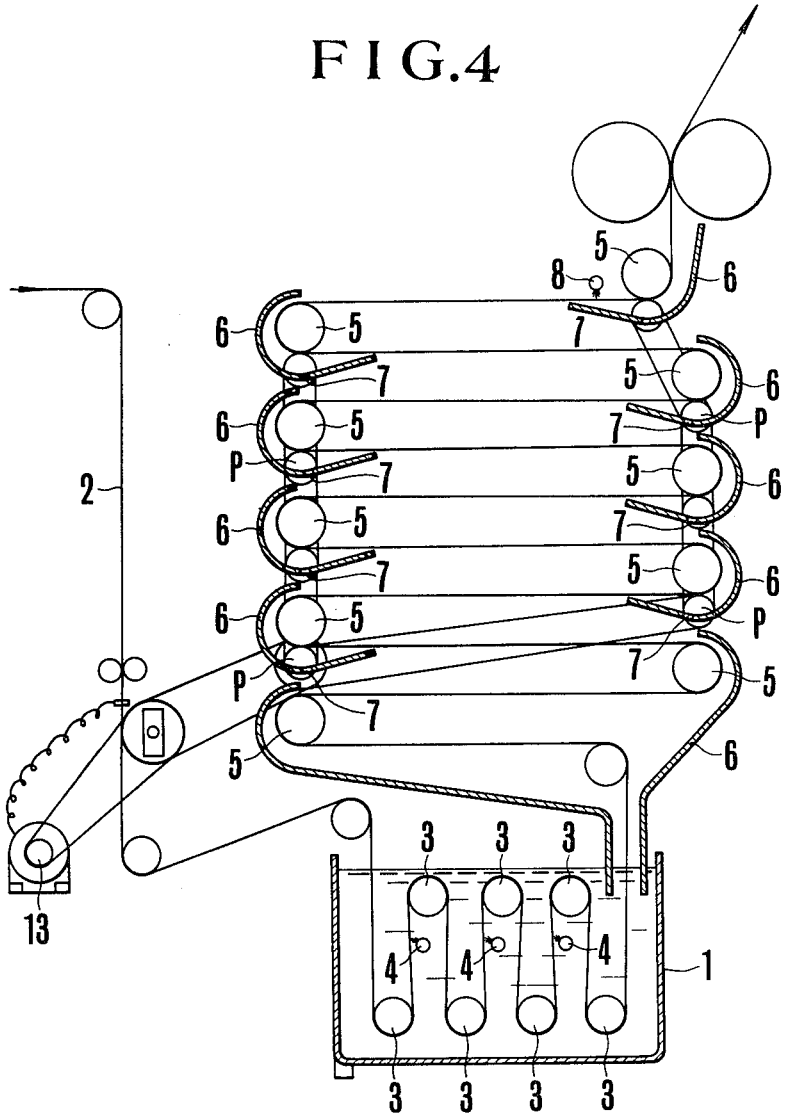
FIG. 4 is a side elevation which particularly shows a mechanism for adjusting the width of water in a water receptacle the mechanism includes a cloth width detection mechanism.
Figure 5:
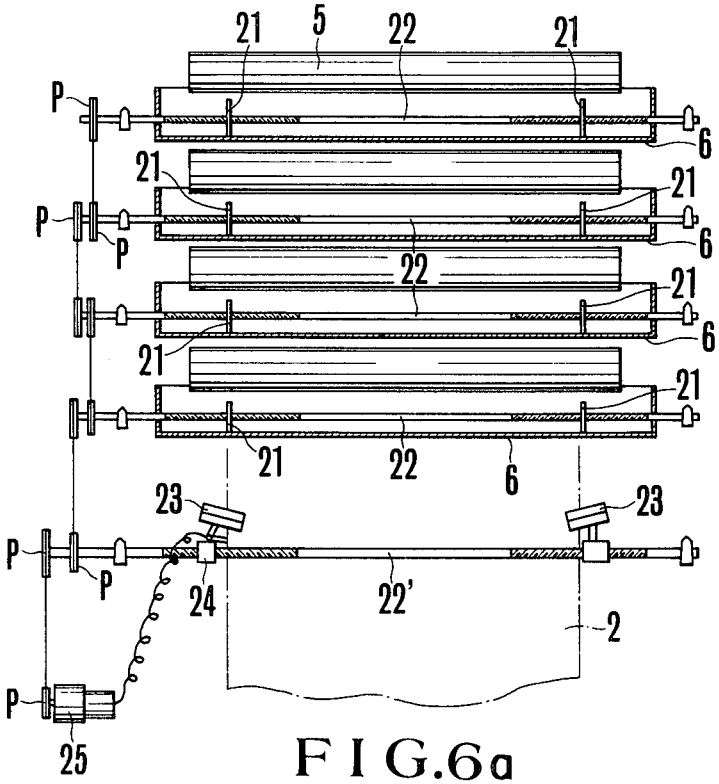
FIG. 5 is a front elevation of the adjusting mechanism showing in cross section the structure within the water receptacle.
Figure 6A:
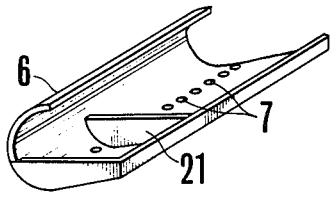
FIGS. 6*a* and 6*b* are partial oblique views showing the interior of one water receptacle.
Figure 6B:
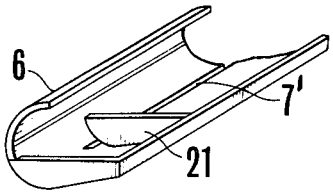

FIG. 4 is a side elevation illustrating the mechanism for adjusting the volume of water within the water receptacle as it is filled and FIG. 5 is a front elevation showing the structure of mechanism, partially in cross-section, wherein the important component members shown by the numbers 1 to 8 were already explained, therefore, further explanation is not provided here. The adjusting mechanism includes a pair of movable side plates 21 provided on the opposite sides of each water receptacle 6 and a screw bar 22 for each pair of side plates. Each screw bar has oppositely threaded portions engraved on the opposite end portions and in engagement with the pair of movable side plates 21. A screw bar 22' is located below the lowest screw bar 22 and has cloth guiders 23 and cloth width detectors 24 threadedly engaged with the threaded portions thereof. Each of the screw bars 22, 22' and a driving axle of a motor 25 have one or two at one end thereof with the pulleys arranged in one or two rows. Belts are placed around the pulleys P between the screw bars 22, 21 which are adjacent to each other vertically and between the screw bar 22 and the lowest screw bar 22' which has cloth guiders threaded thereon, and further between the screw bar 22' and the motor 25. The detector 24 senses the position of edges of the cloth and is coupled to the driving motor 25. The motor 25 is driven by the output of the detector 24, and each of the screw bars 22 rotates through the belt spanned on the pulleys P in a synchronized manner. Then each pair of movable side plates 21, 21 within each water receptacle 6 slide in opposite directions for adjusting the volume of water within the receptacle as it is filled to the water receiving width corresponding to the size of the cloth being processed, while the cloth guiders 23 are shifted in opposite directions by the rotation of the screw bar 22' for detecting the width of the cloth. That is, each pair of movable side plates 21, 21 and the cloth guiders 23 are simultaneously shifted for matching the cloth width. Further, while each water receptacle (6) has a number of water flow outlets 7 perforated therein as shown in FIG. 6*a*, a slit 7' could be provided as shown in FIG. 6*b*.

As the above mentioned water filled up volume adjusting mechanism is provided in the example of an apparatus according to the present invention, movable side plates 21, 21 positioned at both ends of each water receptacle 6 move in opposite directions one another to thus the water receiving width, that is, the water filled up volume of the water receptacle 6, can be automatically adjusted as somewhat larger than the width of the cloth depending on the actual width of the cloth, therefore, the water receptacles have a water receiving width suited to the width of the cloth being processed, thus water can be saved yet water washing effectively carried out on the total width of the cloth. Further, the invention can be applied to an already installed washing apparatus or an improvement can be made thereon in a simple manner.

What is claimed is:

1. A continuous water washing apparatus for cloth comprising a pre-washing tank, first multi-layer guide rolls and pressurized air blow out pipes located within said tank, second multi-layer guide rolls arranged above said tank in a staggered manner and in two laterally spaced vertical columns for pulling the cloth upwardly from said tank and shifting the cloth horizontally in a zigzag manner over said second guide rolls, a water receptacle provided at and below each of said second guide rolls in the vertical columns, a cleaning water supply volume adjusting mechanism connected to the uppermost said water receptacle said cleaning water supply volume adjusting mechanism including a cloth shifting speed detection mechanism, another mechanism including a tension detection mechanism and a cloth sag prevention member to hold the shifting cloth horizontally, and a cloth width detection mechanism for adjusting the water filled up width of said water receptacles.

2. A water washing apparatus according to claim 1, in which said cleaning water supply volume adjusting mechanism comprises a water supply pipe arranged for filling water into the uppermost said water receptacle, a flow meter connected to said water supply pipe, an adjusting valve, follower rolls rotated synchronously with the shifting of the cloth in the washing apparatus, a cloth shifting speed detector connected to and actuated by the rotating power of said rolls, a driving motor connected to said adjusting valve for operating said valve and a converter connected to said detector and to said driving motor for operating said driving motor based on the output from said detector.

3. A water washing apparatus according to claim 1, wherein said cloth sag prevention mechanism comprises an attaching frame, a vertical row of touch rolls positioned almost centrally between the vertical columns of said guide rolls and supported in a freely rotatable manner in said attaching frame, a tension detector having a pair of light emitters and light receivers arranged to contact both edges of the cloth being shifted, a motor connected to said tension detector and to said attaching frame and arranged to be driven by the detection output of said detector to shift said attaching frame up and down, a roll supporting frame supporting said guide rolls positioned in one of said vertical columns in a freely rotatable manner, and a handle connected to said roll supporting frame for shifting said supporting frame horizontally for adjusting the distance between said guide rolls supported on said frame and the other vertical column of said guide rolls at the opposite column.

4. A water washing apparatus according to claim 1, wherein said cloth width detection mechanism for adjusting the water filled up width of said water receptacle, comprises a pair of movable side plates for each said water receptacle with each side plate in each said pair of side plate located on an opposite side of said water receptacle from the other side plate of said pair first screw bars having oppositely threaded portions engraved in the opposite end parts thereof and each said screw bar disposed in threaded engagement with one said pair of movable side plates a second screw bar located below the lowermost one of said first screw bars and having oppositely threaded portions engraved in the opposite end parts thereof and having cloth guiders and cloth width detectors threaded on the threaded portions thereof, a motor connected to and driven by said cloth width detectors, said motor including a driving axle, pulleys mounted on one end of each of said first and second screw bars and on the driving axle of said motor said pulleys aligned in at least one vertically extending row, at least one belt coupling said pulleys and arranged to be driven by said motor connected to said cloth width detectors, and a motor connected to said detector and driven by its output.

* * * * *